US005290976A

United States Patent [19]

Bahjat et al.

[11] Patent Number: 5,290,976

[45] Date of Patent: * Mar. 1, 1994

[54] AUTOMATIC SELECTION OF DIFFERENT MOTION PROFILE PARAMETERS BASED ON AVERAGE WAITING TIME

[75] Inventors: Zuhair S. Bahjat, Farmington; Gerald B. Fried, Burlington, both of Conn.

[73] Assignee: Otis Elevator Company, Farmington, Conn.

[ * ] Notice: The portion of the term of this patent subsequent to Aug. 31, 2010 has been disclaimed.

[21] Appl. No.: 508,322

[22] Filed: Apr. 12, 1990

[51] Int. Cl.[5] ..... B66B 1/24

[52] U.S. Cl. ..... 187/118; 187/116

[58] Field of Search ..... 187/125, 122, 118, 116

[56] References Cited

U.S. PATENT DOCUMENTS

| | | | |
|---|---|---|---|
| 3,891,064 | 6/1975 | Clark | 187/118 |
| 4,658,935 | 4/1987 | Holland | 187/122 |
| 4,727,499 | 2/1988 | Tsuji | 364/554 |
| 4,793,443 | 12/1988 | MacDonald et al. | 187/127 |
| 4,838,384 | 6/1989 | Thangavelu | 187/125 |

OTHER PUBLICATIONS

Patent Abstracts of Japan (vol. 13, No. 506 (M-892) Application No. 1-203187, Kenji Sasaki, Aug. 15, 1989.

G. C. Barney and S. M. Dos Santos "Lift Traffic Analysis Design & Control" Pub. by Peter Peregrinus Ltd Southgate House, Stevenage, Herts SG1HQ England (1977).

*Primary Examiner*—Steven L. Stephan
*Assistant Examiner*—Robert E. Nappi

[57] ABSTRACT

An elevator system (FIG. 1) employing a microprocessor-based group controller (FIG. 2) communicating with elevator cars (3,4, . . . ) to affect the assignment of cars to hall calls at a plurality of floors in the building, using different, speedier car motion profiles and system motion parameters when the average waiting time is increasing beyond an acceptable delta (Δ) [e.g. ±15% or ±5 sec.] or exceeds a specific pre-set limit (e.g. thirty-five seconds), indicating high traffic intensity (FIG. 3). This causes each of the assigned car(s) going to the relevant floor(s) to be given a higher jerk rate and acceleration & deceleration rates for reduced waiting time and improved service time. When relatively high intensity traffic conditions are no longer present, the relevant cars are changed back to a profile with a lower jerk rate and acceleration & deceleration rates for enhanced passenger comfort. To measure the average waiting time, the number and the time entered of all hall calls placed is collected, along with the floors involved in the calls, during an interval, and the average waiting time for the calls computed. In the first approach the computed average waiting time is compared to the previous computed average waiting time and, if it equals or exceeds an unacceptable delta (Δ) or difference, the profile is increased. In the other approach, if the computed average waiting time exceeds the pre-set limit, the profile is increased. The highest available profile is also preferably used whenever the car is empty.

11 Claims, 4 Drawing Sheets

GROUP
CTRLR 17
22
15
16
CAR
CTRLR
OP/MO
PPT
25
27
29
7
5
26
28
30
8
CAB
CTRLR
35
3
CAB
SPT
13
33
23
24
18
19
20
6
36
14
4
34
12
11
21
LOB
PNL
1
2
9
31
32
10
HOISTWAY
"A"
HOISTWAY
"F"

AUTOMATIC SELECTION OF DIFFERENT MOTION PROFILE PARAMETERS BASED ON AVERAGE WAITING TIME

REFERENCE TO RELATED APPLICATIONS

This application relates to some of the same subject matter as the co-pending applications listed below, owned by the assignee hereof, the disclosures of which are incorporated herein by reference:

Ser. No. 07/508,319 of Zuhair S. Bahjat & V. Sarma Pullela entitled "Elevator System With Varying Motion Profiles And Parameters Based on Crowd Related Predictions" filed on Apr. 12, 1990 and Ser. No. 07/375,429 of Skalski entitled "Elevator Speed Dictation System" filed Jul. 3, 1989 now U.S. Pat. No. 5,035,301.

TECHNICAL FIELD

The present invention relates to hall calls in elevator systems and to varying the motion profiles of the elevator cars and motion parameters of the system based on the average waiting time of the passengers as a measure of traffic intensity, with a predilection to moving to a higher, speedier profile for high intensity traffic, achieving higher system performance, but moving to a lower, slower profile for low intensity traffic, achieving greater passenger comfort.

BACKGROUND ART

Motion Profile & System Motion Parameters

In general, the need to control the velocity of an elevator is well known. Reference is had, for example, to assignee's U.S. Pat. No. 4,751,984 of Walter L. Williams, Donald G. McPherson & Arnold Mendelsohn entitled "Dynamically Generated Adaptive Elevator Velocity Profile" issued Jun. 21, 1988, as well as to the art cited therein, the disclosures of which are incorporated herein by reference.

As noted in the Williams et al patent, automatic elevator operation involves the control of elevator velocity with respect to zero or stop, at the beginning and the end of a trip, to speeds therebetween, which minimize trip time while maintaining comfort levels and other constraints. The time change in velocity for a complete trip is termed the car's "velocity" or "motion profile." Automatic elevator control further requires control of the distance travelled during a trip in order to accomplish a precision stop at the destination floor. See also said '301 patent.

Thus, in an elevator system a car is typically moved from one location to another with an acceptable motion profile and system motion parameters which involve acceptable car "jerk" and acceleration & deceleration. The particular motion profile and motion parameters selected represent a compromise between the desire for "maximum" speed and, inter alia, the need to maintain acceptable levels of comfort for the passengers.

Maximum speed, of course, allows the car to get from floor location to floor location in as short a time as possible, so as to minimize the service time and the waiting time of passengers and improve handling capacity. Maximum speed thus achieves the best service possible, but then this must be tempered with the need for acceptable limits of passenger comfort. Thus, for example, with respect to the latter constraint, too great a rate of acceleration or deceleration produces unacceptable passenger discomfort.

In view of the necessity of this compromise between minimizing service time and the need for passenger comfort, an acceptable motion profile governing the movement of each elevator car as it moved from one location to another was included in the design of an elevator system and remained fixed during the normal or regular operation of the system. Such acceptable profile varies from marketing territory to marketing territory (e.g. the North American market generally places greater emphasis on speed, while the Pacific market places greater emphasis on comfort) or indeed from customer to customer, but once set in the system the profile in the established prior art remained fixed during the normal operation of the system.

Thus, regardless of which motion profile was ultimately decided upon, it was typically pre-selected and fixed prior to starting the operation of the system. These fixed motion profile parameters provided a certain level of performance and ride quality that would stay the same for the rest of the elevator life, unless changed by a mechanic or an adjuster at the job site. If the pre-set parameters favored ride quality, then the relatively low acceleration, jerk and deceleration rates of the profile diminished performance, and vice-versa. The system therefore suffered in one way or another from this compromise on a relatively fixed or "permanent" basis.

DISCLOSURE OF INVENTION

The present invention minimizes this problem by changing the selected motion profile during regular system operation to a more performance oriented profile when there is high traffic intensity as measured by the average waiting time for the passengers and a more comfortable profile when there is relatively low traffic intensity, in essence attaining "the best of both worlds" when each of their respective aspects is more important and significant.

The present invention originated from the need to improve elevator service time consistent with acceptable limits of car passenger comfort. It achieves this goal within this constraint by, as indicated above, changing the selected motion profile during system operation to a more performance oriented profile when there is high traffic intensity as measured by the average waiting time for the passengers over predefined intervals and a more comfortable profile when there is relatively low traffic intensity as measured by a relatively low average waiting time again over predefined intervals. It is noted that a high intensity type of traffic is independent of whether or not a "crowd" is present at any particular floor.

Exemplary average waiting times in a business elevator system are outlined below:

| Time | Category |
|---|---|
| <25 sec. | Light |
| 25-35 | Moderate |
| >35 | High |

with a "high" waiting time being generally unacceptable.

The invention is particularly directed to alleviating "high" waiting times for hall calls, with car calls being only indirectly considered to the extent they affect hall call waiting time.

In order to achieve the shortest time to serve high intensity traffic, when the cars' speeds can be most effective in providing improved building service, the invention uses a motion profile with higher jerk and acceleration & deceleration rates for the cars assigned to handle the high intensity traffic. Thereafter, when the absence of high intensity traffic is indicated by the average waiting time dropping down to a relatively low level for such a car, the motion profile and motion parameters are returned to a normal pace for enhanced passenger comfort. Thus, the car reverts back to a profile with lower jerk, acceleration & deceleration rates.

In operation, during any selected interval the number of hall calls entered are counted, the floors the calls were entered on are noted, and at the end of that interval, the average waiting time (A.W.T.) for the hall calls is computed, and a command is sent to each elevator to vary (increase/decrease) the then selected motion profile parameters to match and handle the traffic intensity. Thus, during any part of the day (including, e.g., peak time, lunch time, meeting and convention starting times, etc.), the motion profile parameters, including the jerk rate and the acceleration & deceleration rates, may be varied and re-selected for optimum performance or optimum ride quality.

If the average waiting time for the last interval [programmable for, for example, one (1) minute, five (5) minute, fifteen (15) minute, half (½) hour, one (1) hour, etc., intervals] is low, which indicates a low traffic intensity in the building for that period of the day, then the system automatically selects a profile with a lower jerk rate and lower acceleration and deceleration rates, hence providing the riding passengers a better, smoother quality, vibration free ride. Cyclical intervals of the order of five (5) minutes each is exemplary and preferred, although other interval periods are possible, with the range of five to fifteen (5–15) minutes being particularly preferred.

When the average waiting time increases, which indicates an increasing high traffic intensity in the building for that period, then the system automatically selects a profile with a higher jerk rate and higher acceleration and deceleration rates, hence reducing the "flight time" (floor-to-floor time) and getting the riding passengers to their destinations faster.

In one approach of the invention the delta (Δ) of increasing or decreasing the values of the motion parameters values depends on the delta or difference between the last computed and the current computed average waiting time in the building for that period of time. This allows for a dynamic system, in which the computed value of the average waiting time is stored, so that it can be compared to the next computed average waiting time. By using a speedier motion profile when the delta is positive, i.e., when the average waiting time is increasing, an over-all decreasing average waiting time can be achieved through the use of the invention.

Thus, the motion profile parameters selected will be varied based upon average waiting time, which is directly proportional to the building traffic intensity. The selection can be done by selecting an appropriate set of parameters from a table, as described in the exemplary embodiment below, or alternatively, one or more of the parameters can be incrementally changed to obtain the desired increase/decrease in the motion profile.

The approaches of the invention thereby provide reduced waiting time and better service for high intensity traffic at floor(s) for the period of time in question than would otherwise have been achieved by cars with a lower, unvaried, motion profile, particularly where comfort was given greater emphasis.

In another approach of the invention, a specific, preset limit for acceptable average waiting time is used, rather than considering the delta or difference between the last and the current average, waiting time. In the alternate approach, if a pre-set limit is exceeded [e.g. more than thirty-five (>35 sec.) seconds] at one or more floors, the motion profile of the car(s) assigned to the call(s) is increased, speeding up the car(s) and thus decreasing the waiting time(s) for the call(s).

By either one of these techniques, more efficient service is provided by the algorithms used in the preferred exemplary embodiments of the present invention, when high intensity traffic is indicated by relatively high average waiting time.

The present invention thus controls the motion profiles of the elevator cars to be dispatched based on dispatcher algorithms analyzing the average waiting time for the pending hall calls, and using this information to better service the high intensity traffic floor(s) by increasing the motion profile to a heavier, speedier one when hall calls are pending at high intensity traffic floor(s).

Thus, the high intensity traffic sensing features of the present invention use the average waiting times for hall calls and do not require separate sensors to monitor the presence of any crowds or other high intensity traffic.

The invention may be practiced in a wide variety of elevator systems, utilizing known technology, in the light of the teachings of the invention, which are discussed in detail hereafter.

Other features and advantages will be apparent from the specification and claims and from the accompanying drawings, which illustrate an exemplary embodiment of the invention.

BRIEF DESCRIPTION OF DRAWINGS

FIG. 1 is a simplified illustration, partially cut away, of an exemplary elevator system in which the present invention may be incorporated in connection with the group controller and the individual elevator car controllers; while

BEST MODE FOR CARRYING OUT THE INVENTION

Figures 1, 2:
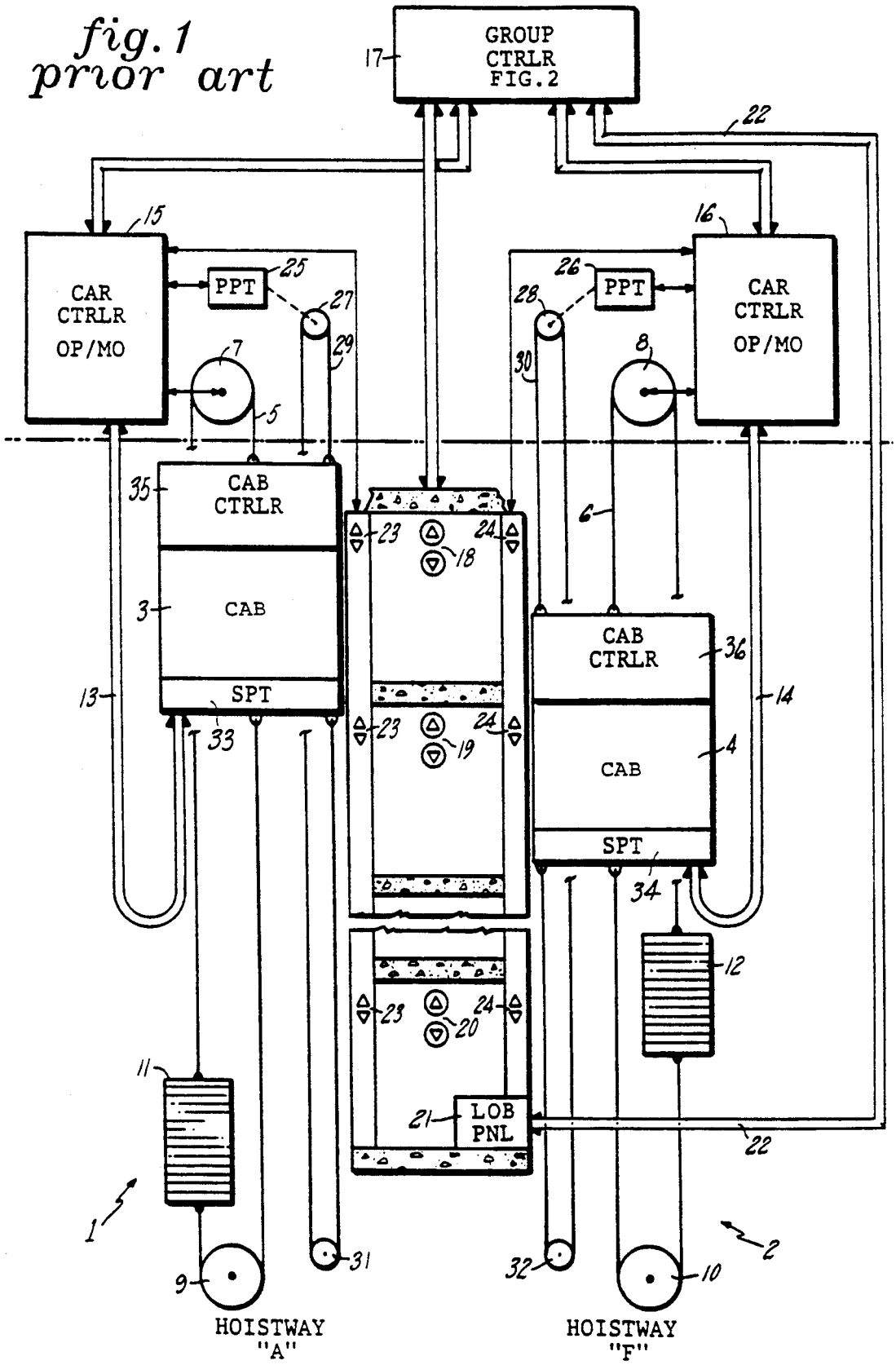
fig. 1 prior art
Figure 2:
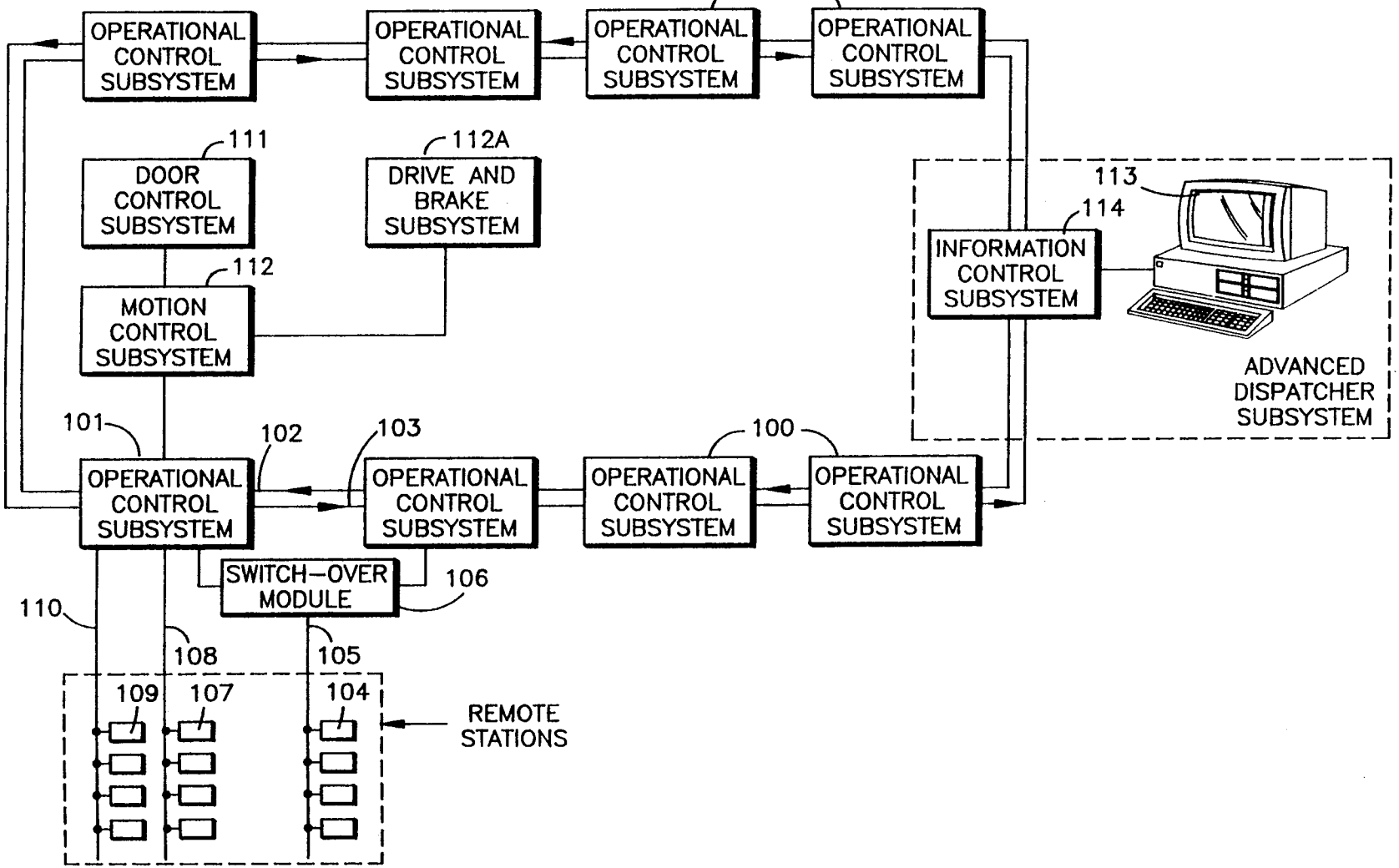
fig.2 prior art
FIG. 2 is a simplified, schematic block diagram of an alternate, exemplary ring communication system for elevator group control, which may be employed in connection with the elevator car elements of the system of FIG. 1, and in which the invention may be implemented in connection with the advanced dispatcher subsystem (ADSS) and the cars' individual operational control subsystems (OCSS) and their related subsystems.

Exemplary Elevator Application (FIG. 1)

For the purposes of detailing an exemplary application for the present invention, the disclosures of U.S. Pat. No. 4,363,381 of Bittar entitled "Relative System Response Elevator Car Assignments" (issued Dec. 14, 1982) and Bittar's subsequent U.S. Pat. No. 4,815,568 entitled "Weighted Relative System Response Elevator Car Assignment With Variable Bonuses and Penalties" (issued Mar. 28, 1989), supplemented by U.S. Pat. No. 5,024,295 of Kandasamy Thangavelu entitled "Relative System Response Elevator Dispatcher System Using 'Artificial Intelligence' to Vary Bonuses and Penalties," as well as of the commonly owned U.S. Pat. No. 4,330,836 entitled "Elevator Cab Load Measuring System" of Donofrio & Games issued May 18, 1982, are incorporated herein by reference.

The preferred application for the present invention is in an elevator control system employing microprocessor-based group and car controllers using signal processing means, which through generated signals communicates with the cars of the elevator system to determine the conditions of the cars and responds to hall calls registered at a plurality of landings in the building serviced by the cars under the control of the group and car controllers, to provide assignments of the hall calls to the cars. An exemplary elevator system with an exemplary group controller and associated car controllers (in block diagram form) are illustrated in FIGS. 1 & 2, respectively, of the '381 patent and described in detail therein.

It is noted that FIG. 1 hereof is substantively identical to FIG. 1 of the '381 and '568 patents. For the sake of brevity the elements of FIG. 1 are merely outlined or generally described below, while any further, desired operational detail can be obtained from the '381 & the '568 patents, as well as others of assignee's prior patents. Additionally, for further example, the invention could be implemented in connection with the advanced dispatcher subsystem (ADSS) and the operational control subsystems (OCSSs) and their related subsystems of the ring communication system of FIG. 2.

In FIG. 1 a plurality of exemplary hoistways, HOISTWAY "A" 1 and HOISTWAY "F" 2 are illustrated, the remainder not being shown for simplicity purposes. In each hoistway an elevator car or cab 3, 4 (etc.) is guided for vertical movement on rails (not shown). Each car is suspended on a steel cable 5, 6, that is driven in either direction or held in a fixed position by a drive sheave/motor/brake assembly 7, 8, and guided by an idler or return sheave 9, 10 in the well of the hoistway. The cable 5, 6 normally also carries a counterweight 11, 12, which is typically equal to approximately the weight of the cab when it is carrying half of its permissible load.

Each cab 3, 4 is connected by a traveling cable 13, 14 to a corresponding car controller 15, 16, which is typically located in a machine room at the head of the hoistways. The car controllers 15, 16 provide operation and motion control to the cabs, as is known in the art.

In the case of multi-car elevator systems, it has long been common to provide a group controller 17, which receives up and down hall calls registered on hall call buttons 18–20 on the floors of the buildings and allocates those calls to the various cars for response, and distributes cars among the floors of the building, in accordance with any one of several various modes of group operation. Modes of group operation may be controlled in part, for example, by a lobby panel ("LOB PNL") 21, which is normally connected by suitable building wiring 22 to the group controller 17 in multi-car elevator systems.

The car controllers 15, 16 also control certain hoistway functions, which relate to the corresponding car, such as the lighting of "up" and "down" response lanterns 23, 24, there being one such set of lanterns 23 assigned to each car 3, and similar sets of lanterns 24 for each other car 4, designating the hoistway door where service in response to a hall call will be provided for the respective up and down directions.

The position of the car within the hoistway may be derived from a primary position transducer ("PPT") 25, 26. Such a transducer is driven by a suitable sprocket 27, 28 in response to a steel tape 29, 30, which is connected at both of its ends to the cab and passes over an idler sprocket 31, 32 in the hoistway well.

Similarly, although not required in an elevator system to practice the present invention, detailed positional information at each floor, for more door control and for verification of floor position information derived by the "PPT" 25, 26, may employ a secondary position transducer ("SPT") 33, 34. Or, if desired, the elevator system in which the present invention is practiced may employ inner door zone and outer door zone hoistway switches of the type known in the art.

The foregoing is a description of an elevator system in general, and, as far as the description goes thus far, is equally descriptive of elevator systems known to the prior art, as well as an exemplary elevator system which could incorporate the teachings of the present invention.

All of the functions of the cab itself may be directed, or communicated with, by means of a cab controller 35, 36 in accordance with the present invention, and may provide serial, time-multiplexed communications with the car controller 15, 16, as well as direct, hard-wired communications with the car controller by means of the traveling cables 13 & 14. The cab controller, for instance, can monitor the car call buttons, door open and door close buttons, and other buttons and switches within the car. It can also control the lighting of buttons to indicate car calls and provide control over the floor indicator inside the car, which designates the approaching floor.

The cab controller 35, 36 interfaces with load weighing transducers to provide weight information used in controlling the motion, operation, and door functions of the car. The load weighing data used in the invention may use the system disclosed in the above cited '836 patent.

An additional function of the cab controller 35, 36 is to control the opening and closing of the door, in accordance with demands therefor, under conditions which are determined to be safe.

The makeup of micro-computer systems, such as may be used in the implementation of the car controllers 15, 16, the group controller 17, and the cab controllers 35, 36, can be selected from readily available components or families thereof, in accordance with known technology as described in various commercial and technical publications. The micro-computer for the group controller 17 typically will have appropriate input and output (I/O) channels, an appropriate address, data & control buss and sufficient random access memory (RAM) and appropriate read-only memory (ROM), as well as other associated circuitry, as is well known to those of skill in the art. The software structures for implementing the present invention and the peripheral features which are disclosed herein, may be organized in a wide variety of fashions.

Exemplary Ring System (FIG. 2)

As a variant to the group controller elements of the system of FIG. 1, in certain elevator systems, as described in co-pending application Ser. No. 07/029,495, entitled "Two-Way Ring Communication System for Elevator Group Control" (filed Mar. 23, 1987), the disclosure of which is incorporated herein by reference, the elevator group control may be distributed to separate microprocessors, one per car. These microprocessors, known as operational control subsystems 100, 101, are all connected together in a two-way ring communication (102, 103). Each 100, 101 has a number of other subsystems and signaling devices, etc., associated with it, as will be described more fully below, but only one such collection of subsystems and signaling devices is illustrated in FIG. 2 for the sake of simplicity.

The hall buttons and lights are connected with remote stations 104 and remote serial communication links 105 to the OCSS 101 via a switch-over module 106. The car buttons, lights and switches are connected through similar remote stations 107 and serial links 108 to the OCSS 101. The car specific hall features, such as car direction and position indicators, are connected through remote stations 109 and remote serial link 110 to the OCSS 101.

The car load measurement is periodically read by the door control subsystem (DCSS) 111, which is part of the car controller. This load is sent to the motion control subsystem (MCSS) 112, which is also part of the car controller. The load in turn is sent to the OCSS 101. DCSS 111 and MCSS 112 are micro-processors controlling door operation and car motion under the control of the OCSS 101, with the MCSS 112 working in conjunction with the drive & brake subsystem (DBSS) 112A.

The dispatching function is executed by the OCSS 101, under the control of the advanced dispatcher subsystem (ADSS) 113, which communicates with the OCSS 101 via the information control subsystem (ICSS) 114. The car load measured may be converted into boarding and deboarding passenger counts by the MCSS 112 and sent to the OCSS 101. The OCSS sends this data to the ADSS 113 via ICSS 114.

Figure 3:
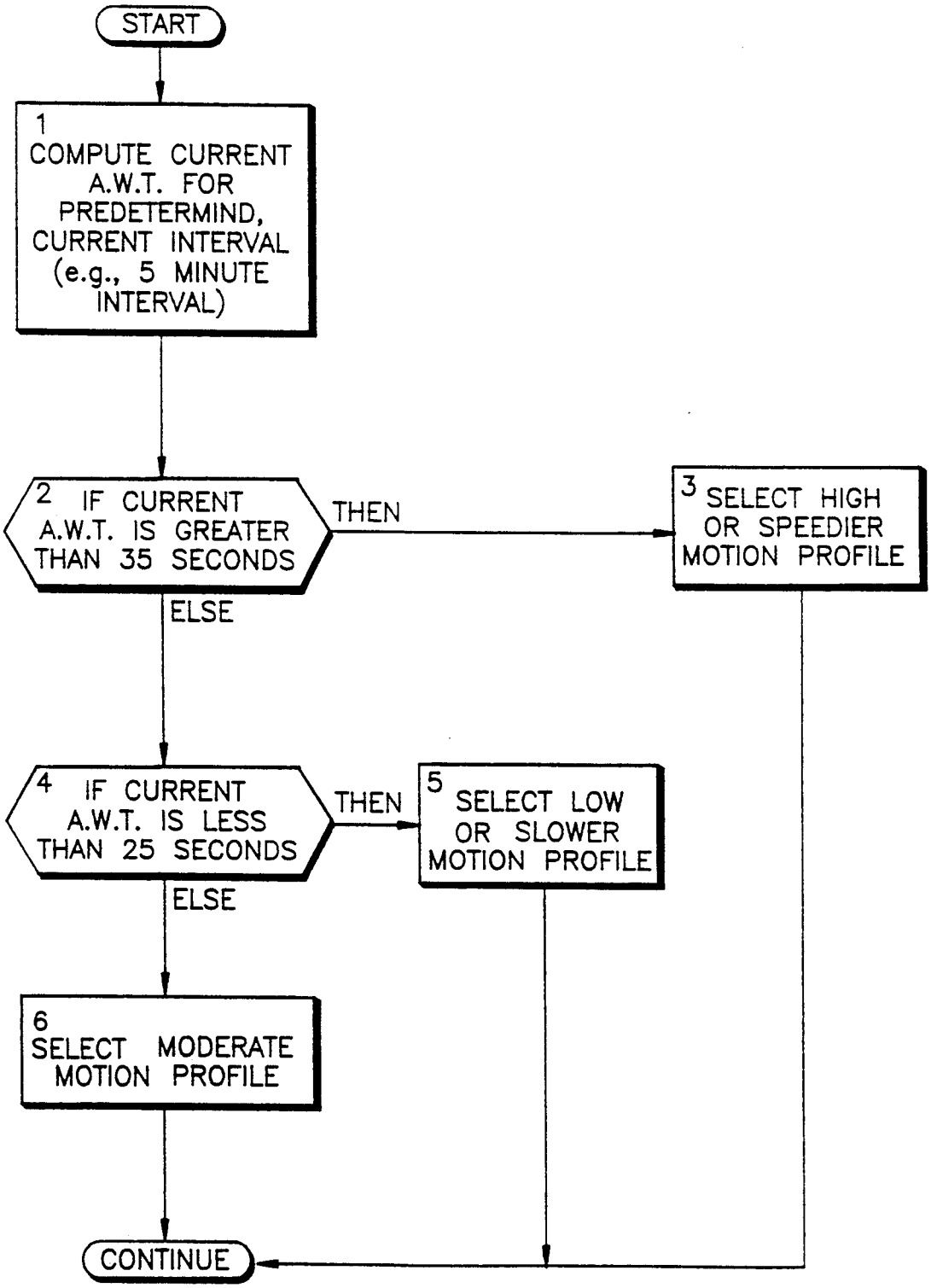
FIG. 3 is a simplified, logic flow diagram for a relatively straight-forward, exemplary algorithm for the methodology used to compute the average waiting time and compare it to a pre-set time value (e.g. 35 seconds) to determine what motion profile varying action is to be taken, as used in a first, preferred, exemplary embodiment of the present invention.

The ADSS 113 through signal processing computes the average waiting time (A.W.T.) based on all of the pending hall calls during an interval, and, in one approach of the invention (FIG. 4), compares the current A.W.T. to the last computed average waiting time and determines whether the average waiting time is decreasing or increasing and what the amount or delta (Δ) of the change is. In an alternate approach the computed average waiting time is compared to a pre-set limit (FIG. 3).

In either approach the ADSS 113 then selects the appropriate values for the motion profile from a stored table of data and sends the selected data for the selected motion profile to each 100, 101. The appropriate motion profile values are sent to the MCSS 112 and used to govern the car's movement under the control of the DBSS 112A, all also as described more fully below. The stored table can either be static, once set in the system and so maintained, or, if so desired, the table can be dynamically computed and changed during system operation based on "learning" or "on-the-fly" technology.

The ADSS 113 also collects inter alia various data for use in making, for example, "artificial intelligence" predictions through appropriate signal generation and processing for use in the elevator control system.

For further background information reference is also had to the magazine article entitled "Intelligent Elevator Dispatching Systems" of Nader Kameli & Kandasamy Thangavelu (*AI Expert*, September 1989; pp. 32–37), the disclosure of which is also incorporated herein by reference.

Owing to the computing capability of the "CPUs," the system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and floor traffic may also be analyzed through signals from each car that indicates for each car the car's load.

Exemplary High Intensity Traffic Methodology

As noted above, the exemplary embodiments of the invention originated from the need to improve dispatcher service by correctly identifying the presence of high intensity traffic based on relatively long average waiting time(s) and, when the presence of high intensity traffic is indicated, changing the motion profile of the assigned car(s) to a heavier or speedier profile, effectively speeding up the car to serve the hall call(s) in less time. This change to a heavier profile is done either when the average waiting time is seen to be increasing, particularly beyond a pre-set acceptable delta (Δ) or amount (see FIG. 4), or when the awaiting passengers behind the hall call(s) have been waiting beyond a set time limit, for example, thirty-five (35 sec.) seconds (see FIG. 3).

With respect to the invention, as well as for other possible uses, traffic data is collected for, for example, each one (1) minute interval during an appropriate time frame covering at least all of the active work day, for example, from 6:00 AM until midnight, in terms of the number of hall calls placed and when they were placed, and the floors involved in those calls.

As a particular example of the computational methodology of the invention, one initially computes the average waiting time based on the relevant traffic data which has been collected. In general, during any selected interval, the time of placement and the number of hall calls entered are recorded and counted, respectively, the floors the calls were entered noted, and at the end of that interval, the waiting time is computed, and, when appropriate, a command signal (high intensity traffic present or not present) is generated and sent to each involved elevator to appropriately vary (increase/decrease) the then selected motion profile parameters to match and handle the traffic intensity.

Thus, during any part of the day (including, e.g., peak time, lunch time, meeting and convention starting times, etc.), the motion profile parameters, including the jerk rate and the acceleration & deceleration rates, may be varied and re-selected to match optimum performance with optimum ride quality.

The average waiting time can be computed in accordance with the following formula:

$$A.W.T. = \frac{\Sigma(\text{Hall Call Waiting Times In Interval})}{\text{Total \# of Hall Calls In Interval}}$$

wherein "A.W.T." is the computed average waiting time. It is noted that in the above formula only those time segments of the call waiting times occurring during the interval are counted and only those hall calls that are registered during the interval are included in the total number. Although this approach does not provide absolute accuracy, since some of the waiting periods will over-lap from one interval to the next, the approach still provides a sufficiently accurate figure if the interval times are properly chosen and are not too short nor too long.

If the average waiting time for the last interval [programmable for, for example, one (1) minute, five (5) minutes, fifteen (15) minutes, half (½) hour, one (1) hour, etc. intervals] is low, which indicates a low traffic intensity in the building for that period of the day, then, as will be seen more fully below in connection with FIGS. 3 & 4, the system automatically selects a profile with a lower jerk rate and lower acceleration and deceleration rates, hence providing the riding passengers a better, smoother quality, vibration free ride. Intervals of the order of five (5) minutes are preferred, but are subject to substantial variation depending on the characteristics of the elevator system involved.

When the average waiting time increases, which indicates a high traffic intensity in the building for that period, then, as will be seen more fully below in connection with FIG. 4, the system automatically selects a profile with a higher jerk rate and higher acceleration and deceleration rates, hence reducing the "flight time" (floor-to-floor time) and reducing the waiting time for the awaiting passengers at a relatively high traffic intensity floor(s).

Where there are move than two stored, available profiles, the delta (Δ) of increasing or decreasing the motion parameters values can depend on the delta or change between the last and current average waiting time in the building for that period of time or interval. For example, an unacceptable delta (Δ) value of, for example, fifteen (15%) percent or, in terms of a time period, five (5 sec.) seconds, can be pre-set in the system, and, when this pre-set delta is equaled or exceeded (i.e., $\Delta_{A.W.T.} \geqq 5$ sec.), the motion profile is appropriately changed, i.e., increased or decreased, depending upon the direction of the change, i.e., increasing or decreasing, respectively. Thus, for example, if the last average waiting time for the previous interval was thirty (30 sec.) seconds, and the current computed average waiting time is now thirty-five (35 sec.) seconds, this change is an increase or delta of five (5) seconds, which equals (if the set limit is 5 sec.) or exceeds (if the set limit is 15%, or, in this example, 4.5 sec.) the pre-set unacceptable delta (Δ) or difference.

Thus, the motion profile parameters selected are varied based upon the average waiting time, which is directly proportional to the building traffic intensity. The selection can be done by selecting an appropriate set of parameters from a table, as described more fully below, or alternatively, one or more of the parameters could be incrementally changed to obtain the desired increase/decrease in the motion profile.

Varying Motion Profile & Parameters Based on Set Limit (FIG. 3)

In the relatively straight-forward algorithm of FIG. 3, in step 3-1 the current average waiting time is computed for the current interval (e.g. 5 min.), using for example the formula above. In step 3-2, if the computed A.W.T. is in excess of a pre-set limit, for example, thirty-five (35 sec.) seconds, the high or speedier profile is selected in step 3-3.

On the other hand, if in step 3-2 the A.W.T. is not greater than thirty-five (35) seconds, and, if in step 3-4 the current A.W.T. is less than, for example, twenty-five (25) seconds, then in step 3-5 a low or slower motion profile is selected. Otherwise ($25 \leqq$ A.W.T. $\geqq 35$), in step 3-6 a moderate motion profile is selected.

Thus, assuming three motion profile sets are available, a car will vary throughout the three profiles as the traffic intensity goes through its cycles.

Figure 4:
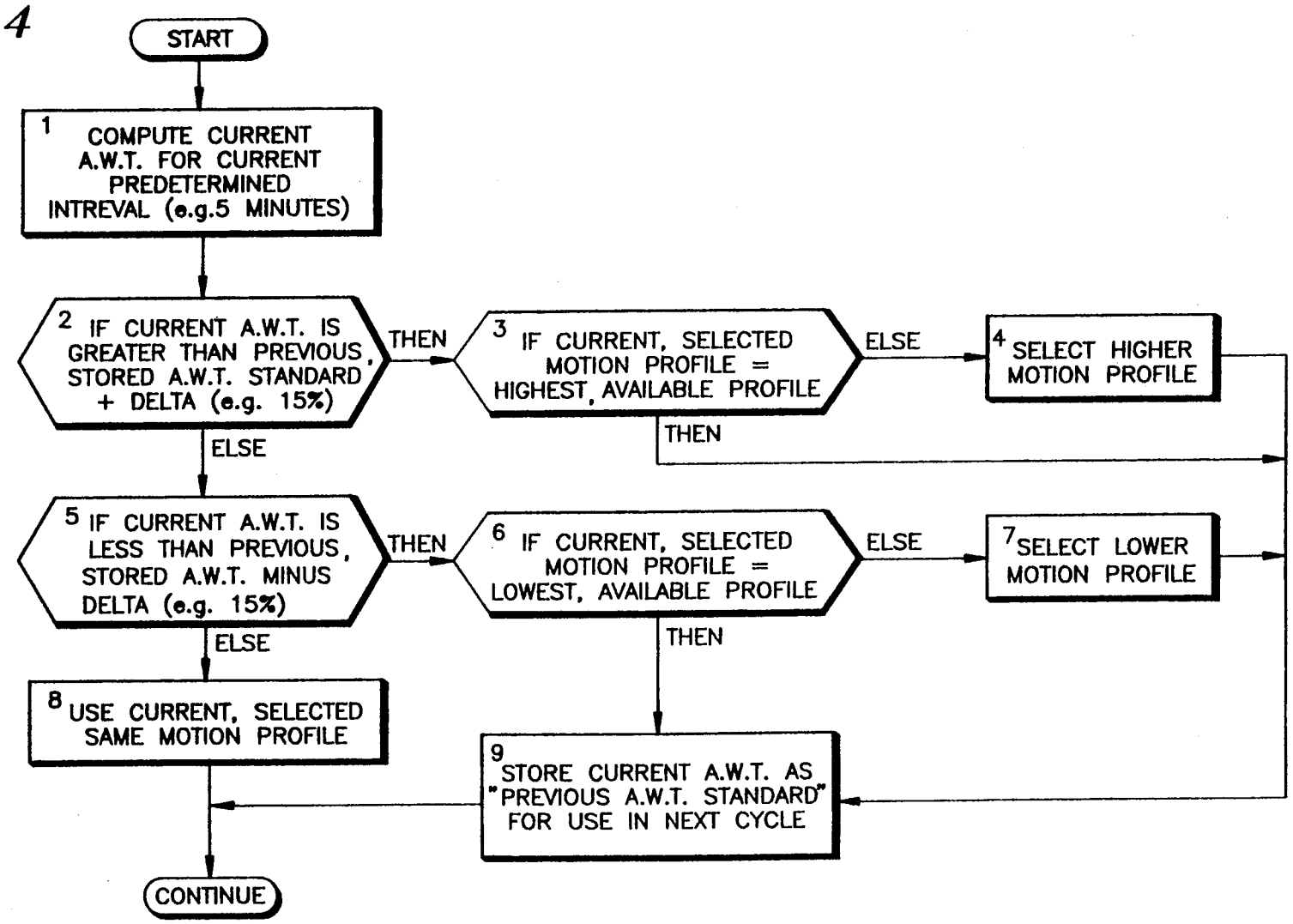
FIG. 4 is a simplified, logic, flow chart diagram for a second, exemplary, algorithm for the methodology used to vary a car's motion profile based on an evaluation of the delta or amount of change in the average waiting time, as indicating the intensity of the traffic, and generating a signal accordingly.

Varying Motion Profile & Parameters Based on Delta (FIG. 4)

FIG. 4 provides in step-by-step format a more involved, sophisticated logic, flow chart diagram for the exemplary algorithm for the methodology used to vary a car's motion profile and the system's motion parameters based on substantial changes or swings (deltas) in the computed average waiting time.

In step 4-1 the current average waiting time is computed for the current interval (e.g. 5 min.), using for example the formula above. In step 4-2, if the computed A.W.T. is in excess of a previous, stored A.W.T. standard plus (+) a set delta (e.g. 15%), then, unless the current, selected motion profile already equals the highest available profile step 4-3, a higher motion profile is selected in step 4-4. In step 4-9 the current, computed A.W.T. is stored to then serve as the "previous A.W.T. standard" for future use in step 4-2.

On the other hand, if in step 4-2 the current A.W.T. is equal to or less than (≦) the stored A.W.T. standard, and, then, if in step 4-5 the current A.W.T. is less than the previous, stored A.W.T. minus delta (e.g. 15%), then in step 4-7 a lower motion profile is selected (unless of course step 4-6 shows that the car is already at the lowest available profile). In step 4-9 the current, computed A.W.T. is stored to then serve as the "previous A.W.T. standard" for future use in step 4-2.

However, if in step 4-5 the current, computed A.W.T. effectively is within the delta range (±Δ) of the previous A.W.T. standard, viz. the change in A.W.T. is relatively small, then in step 4-8, no change is made in the selected motion profile.

Thus, as can be seen from the foregoing, whenever the change in the average waiting time is significant (e.g., >15%), causing the car's motion profile to be changed (if it has not already been set to the extreme profile), the current, computed A.W.T. then becomes the "standard" (step 4-9) against which the next computed average waiting time(s) will be compared. On the other hand, if the change in average waiting time is relatively modest, no change in either the profile or the A.W.T. "standard" is made.

Profile Data Table

Whether the algorithm of FIG. 3 or FIG. 4 is used, in either event the jerk, acceleration & deceleration rate values of the stored profiles can be maintained in a data table for selection in accordance with the sequences of the particular algorithm, and sent to the motion control subsystem MCSS 112 as a dictated profile.

An exemplary profile data table is presented below.

| Variant | Accelera. Factor (ft./sec$^2$) | Jerk Factor (ft./sec$^3$) | Decelera. Factor (ft./sec$^2$) |
|---|---|---|---|
| Speedier | 8 | 4 | 4 |
| Moderate | 4 | 3 | 3 |
| Slower | 2 | 2 | 2 |

For example, with an unacceptable average waiting time, i.e., "ON," the speedier profile may have an acceleration factor of eight feet per second per second (8'/sec.$^2$), a jerk factor of four feet per second per second per second (4'/sec.$^3$) and a deceleration factor of four feet per second per second (4'/sec.$^2$) is selected.

In contrast, if a "high intensity traffic" signal is not present ("high intensity traffic" signal reset or "OFF") and there is relatively little traffic, then a "light" profile is selected from the car's motion profile data table. For example, the slower profile may have with an acceleration factor of two feet per second per second (2'/sec.$^2$), a jerk factor of two feet per second per second per second (2'/sec.$^3$) and a deceleration factor of two feet per second per second (2'/sec.$^2$) is selected. For example, the moderate profile may have an acceleration factor of four feet per second per second (4'/sec.$^2$), a jerk factor of three feet per second per second per second (3'/sec.$^3$) and a deceleration factor of three feet per second per second (3'/sec.$^2$) is selected.

Of course, if so desired, an even more sophisticated, relatively complex or fine-tuned profile selection process could be used. Thus, for further example, the greater the increase in average waiting time, the speedier the selected profile, may be in.

The moderate profile is used as the "default" set of factors as may be called for, for example, in the "contract" for the elevator system. The stored values in the table typically can be set and later changed (if so desired) on site by field personnel during maintenance.

Alternatively, if so desired, rather than an operationally static set of table values, selected ones of the values could be dynamically computed and up-dated by the ADSS to accommodate, for example, varying traffic intensity conditions. Additionally, in the exemplary table above, additional values profile could be stored, if so desired.

The car is moved to the assigned floor under the control of the drive & brake subsystem DBSS 112A in accordance with the factors or parameters contained in the selected, dictated motion profile in MCSS 112.

As noted in the Williams et al patent and the Skalski patent, in order to provide rapid, controlled and smooth motion control in an elevator, a velocity profile is generated which (within system constraints) sets the jerk, acceleration and equipment limitations. Typical, exemplary requirements for a high performance system are:

| | |
|---|---|
| RISE | up to 400M |
| LOADS | 900 TO 3600 KG |
| SPEEDS | 2.5 to 10 M/S |
| ACCEL. | up to 1.5 M/S$^2$ |
| JERK | up to 3.0 M/S$^3$ |
| LEVELING | ±0.006M |

The function of the profile generator is to bring the car to the target position within the desired acceleration/deceleration and jerk constraints. In accordance with the present invention, just before a run, the constraints are changed selected. The profile generator is designed in a structured fashion, thereby permitting adaptation to changing circumstances.

The overall car position control system (MCSS 112 & DBSS 112A) should bring the car to its destination in a minimum amount of time (subject to the set minimum passenger comfort level existing in connection with the sped-up profile used when high intensity traffic is sensed), without vibrations or overshoot. The overall positioning accuracy sought is usually better than plus-or-minus three millimeters (±3 mm), although plus-or-minus six millimeters (±6 mm) may, for example, be considered acceptable.

Although this invention has been shown and described with respect to at least one detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

We claim:

1. A method of operating an elevator system to provide faster than normal car travel to service higher intensity traffic in a building, comprising:

providing a plurality of different sets of car motion profile factors, one set defining a normal motion profile in response to which a car travels at normal speed and one set defining a speedier motion profile in response to which a car travels at faster than normal speed;

determining, in each one of a plurality of successive relatively short time intervals, the average amount of time per hall call that registered hall cells remain unserviced;

providing a predetermined criterion for determining a characteristic of traffic intensity in response to said determined average amount of time;

providing said set defining a speedier motion profile in response to the relationship between said criterion and said determined average amount of time indicating a high traffic intensity and otherwise providing another one of said sets; and dispatching an elevator car to service a call utilizing the provided one of said sets to control the motion of said car.

2. A method according to claim 1 wherein said criterion is a high threshold amount of time and said set defining a speedier motion profile is provided in response to said determined average amount of time being in excess of said high threshold amount of time.

3. A method according to claim 2 further comprising:

providing a set of car motion profile factors defining a slower motion profile in response to which a car travels at slower than normal speed;

providing a low threshold amount of time; and wherein said set defining a speedier motion profile is provided in response to said determined average amount of time being in excess of said high threshold amount of time, said set defining a slower motion profile is provided in response to said determined average amount of time being less than said low threshold amount of time, and otherwise another one of said sets is provided.

4. A method of operating an elevator system to provide faster than normal car travel to service higher intensity traffic in a building, comprising:

providing a plurality of different sets of car motion profile factors, one set defining a normal motion profile in response to which a car travels at normal speed and one set defining a speedier motion profile in response to which a car travels at faster than normal speed;

determining, in each one of a plurality of successive relatively short time intervals, the average amount of time per hall call that registered hall calls remain unserviced;

providing a predetermined criterion for determining a characteristic of traffic intensity in response to said determined average amount of time;

providing, in each successive one of said time intervals, said set defining a speedier motion profile in response to the relationship between said criterion and said determined average amount of time of the next prior one of said intervals indicating a high traffic intensity and otherwise providing the one of said sets which was provided in said next prior interval; and dispatching an elevator car to service a call utilizing the provided one of said sets to control the motion of said car.

5. A method according to claim 4 comprising:

providing said set defining a speedier motion profile in response to said determined average amount of time of said next prior interval exceeding said determined average amount of time of the one of said time intervals preceding said next prior interval by said criterion and otherwise providing said set of said next prior interval.

6. A method according to claim 5 wherein said criterion is a predetermined threshold amount of time.

7. A method according to claim 5 wherein said criterion is a fraction of said determined average amount of time of one of said intervals.

8. A method according to claim 5 comprising:

providing a set of car motion profile factors defining a slower motion profile in response to which a car travels at slower than normal speed; and providing said set defining a speedier motion profile in response to said determined average amount of time of said next prior interval exceeding said determined average amount of time of said preceding interval by said criterion, providing said set defining a slower motion profile in response to said determined average amount of time of said preceding interval exceeding said determined average amount of time of said next prior interval by said criterion, and otherwise providing said set of said next prior interval.

9. A method according to claim 8 wherein said criterion is a predetermined threshold amount of time.

10. A method according to claim 8 wherein said criterion is a fraction of said determined average amount of time of one of said intervals.

11. A method according to claim 5 wherein said preceding interval is the last one of which said determined average amount of time differed by said criterion from one preceding it.

* * * * *